US005200386A

United States Patent [19]

Sens et al.

[11] Patent Number: 5,200,386

[45] Date of Patent: Apr. 6, 1993

[54] AZO DYES FOR THERMOTRANSFER PRINTING

[75] Inventors: Ruediger Sens, Mannheim; Helmut Reichelt, Neustadt; Sabine Gruettner, Mutterstadt; Karl-Heinz Etzbach, Frankenthal; Gunther Lamm, Hassloch, all of Fed. Rep. of Germany

[73] Assignee: BASF Aktiengesellschaft, Ludwigshafen, Fed. Rep. of Germany

[21] Appl. No.: 708,371

[22] Filed: May 31, 1991

[30] Foreign Application Priority Data

Jun. 6, 1990 [DE] Fed. Rep. of Germany ..... 4018067

[51] Int. Cl.[5] ..... B41M 5/035; B41M 5/38

[52] U.S. Cl. ..... 503/227; 428/195; 428/913; 428/914

[58] Field of Search ..... 8/471; 428/195, 913, 428/914; 503/227

[56] References Cited

U.S. PATENT DOCUMENTS

| | | | |
|---|---|---|---|
| 4,698,651 | 10/1987 | Moore et al. | 503/227 |
| 4,764,178 | 8/1988 | Gregory et al. | 8/471 |
| 4,939,118 | 7/1990 | Etzbach et al. | 503/227 |
| 4,960,873 | 10/1990 | Schläfer et al. | 534/632 |

FOREIGN PATENT DOCUMENTS

| | | | |
|---|---|---|---|
| 0133011 | 2/1985 | European Pat. Off. | 503/227 |
| 0133012 | 2/1985 | European Pat. Off. | 503/227 |
| 0192435 | 6/1986 | European Pat. Off. | 503/227 |
| 0216483 | 4/1987 | European Pat. Off. | 503/227 |
| 0227092 | 7/1987 | European Pat. Off. | 503/227 |
| 0227094 | 7/1987 | European Pat. Off. | 503/227 |
| 0258856 | 3/1988 | European Pat. Off. | 503/227 |

OTHER PUBLICATIONS

Japan Abstract, JP-A-86 199,997, Sep. 4, 1986.

Japan Abstract, JP-A-86 283-595, Dec. 13, 1986.

*Primary Examiner*—B. Hamilton Hess

*Attorney, Agent, or Firm*—Oblon, Spivak, McClelland, Maier & Neustadt

[57] ABSTRACT

Azo dyes useful for thermotransfer printing have the formula

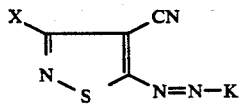

I where the substituents have the following meanings:

X is a radical of the formula IIa or IIb $R^1—O—(CH_2)_n—$ or IIa

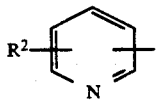

IIb $R^1$ is H, $C_1$–$C_6$-alkyl or phenyl which may be substituted by $C_1$–$C_4$-alkyl, $C_1$–$C_2$-alkoxy, chlorine, bromine or cyano, $R^2$ is H, $C_1$–$C_4$-alkyl, $C_1$–$C_4$-alkoxy, chlorine or bromine, n is 1 or 2, K is a radical of a coupling component II

H—K III of the aniline, aminonaphthaline, pyrazole, diaminopyridine, hydroxypyridone or tetrahydroquinoline series.

6 Claims, No Drawings

AZO DYES FOR THERMOTRANSFER PRINTING

The present invention relates to the use in thermotransfer printing of azo dyes of the formula I

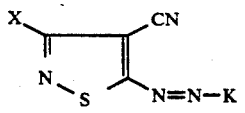

I where the substituents have the following meanings:

X is a radical of the formula IIa or IIb $R^1—O—(CH_2)_n—$ or IIa

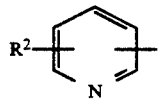

IIb where $R_1$ is hydrogen, $C_1$–$C_6$-alkyl, or phenyl which may be substituted by $C_1$–$C_4$-alkyl, $C_1$–$C_2$-alkoxy, chlorine, bromine or cyano, n is 1 or 2, and $R^2$ is hydrogen, $C_1$–$C_4$-alkyl, $C_1$–$C_4$-alkoxy, chlorine or bromine, and K is the radical of a coupling component III

H—K III of the aniline, aminonapthaline, pyrazole, diaminopyridine, hydroxypyridone or tetrahydroquinoline series and specifically to a process for transferring these azo dyes by diffusion from a transfer to a plastic-coated substrate with the aid of a thermal printing head.

The technique of thermotransfer printing is common knowledge; suitable heat sources besides lasers and IR lamps are in particular thermal printing heads capable of emitting short heat pulses lasting fractions of a second.

In this preferred embodiment of thermotransfer printing, a transfer sheet which contains the transfer dye together with one or more binders, a support material and possibly further assistants such as release agents or crystallization inhibitors is heated from the back with the thermal printing head, causing the dye to migrate out of the transfer sheet and to diffuse into the surface coating of the substrate, for example into the plastic coat of a coated sheet of paper.

The essential advantage of this process is that the amount of dye to be transferred (and hence the color gradation) can be controlled in a specific manner via the amount of energy supplied to the thermal printing head.

Thermal transfer printing is in general carried out using the three subtractive primaries yellow, magenta and cyan (with or without black), and the dyes used must have the following properties to ensure optimal color recording: ready thermal transferability, little tendency to migrate within or out of the surface coating of the receiving medium at room temperature, high thermal and photochemical stability, and also resistance to moisture and chemicals, no tendency to crystallize on storage of the transfer sheet, a suitable hue for subtractive color mixing, a high molar absorption coefficient, and ready industrial availability.

It is very difficult to meet all these requirements at one and the same time. In particular, the magenta dyes used to date have not been fully satisfactory. This is also true for example of the azo dyes described, and recommended for thermal transfer, in U.S. Pat. No. 4,764,178, which have coupling components based on aniline, tetrahydroquinoline, aminoquinoline or julolidine, and also of the azo dyes known from EP-A-258,856 and U.S. Pat. No. 4,698,651 for the same purpose which have coupling components based on aniline, these dyes differing from the azo dyes I inter alia by the nature of the substituent in the thiazole ring which is ortho to the nitrogen atom.

The azo dyes I themselves are known from earlier German Patent Applications P 38 10 643.4 and P 38 16 698.4 or can be obtained by the methods mentioned therein.

It is an object of the present invention to find suitable red and yellow dyes for thermotransfer printing which come closer to the required property profile than the prior art dyes.

We have found that this object is achieved by the azo dyes I defined at the beginning.

We have also found a process for transferring azo dyes by diffusion from a transfer to a plastic-coated substrate with the aid of a thermal printing head, which comprises using for this purpose a transfer on which are situated one or more of the azo dyes I defined at the beginning.

Suitable alkyl $R^1$ or $R^2$ is in particular methyl, ethyl, propyl, isopropyl, butyl, isobutyl, sec-butyl or tert-butyl. Alkyl $R^1$ may also be pentyl, isopentyl, neopentyl, tert-pentyl, hexyl or 2-methylpentyl.

Alkoxy $R^2$ is for example methoxy, ethoxy, propoxy, isopropoxy, butoxy or isobutoxy.

Substituted phenyl $R^1$ is for example methylphenyl, ethylphenyl, methoxyphenyl, ethoxyphenyl, chlorophenyl, bromophenyl or cyanophenyl, in each of which the substituents are in position 2, 3 or 4.

Preferred X of the formula IIa or IIb is for example:

Methoxymethyl, ethoxymethyl, propoxymethyl, butoxymethyl, 2-methoxyethyl, 2-ethoxyethyl, 2-propoxyethyl, 2-butoxyethyl, 2-pentyloxyethyl, 2-hexyloxyethyl, or 2-, 3- or 4-pyridyl.

Preferred coupling components III are:

aniline derivatives of formula IIIa

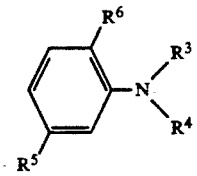

IIIa aminonaphthaline derivatives of the formula IIIb

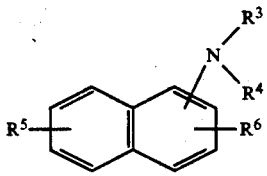

IIIb pyrazole derivatives of the formula IIIc

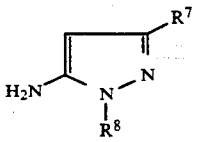

IIIc diaminopyridine derivatives of the formula IIId

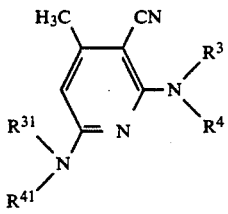

IIId hydroxypyridone derivatives of the formula IIIe

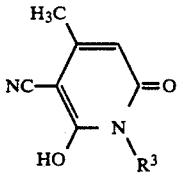

IIIe tetrahydroquinoline derivatives of the formula IIIf

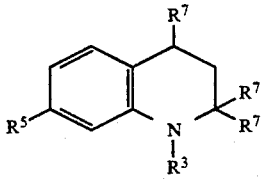

IIIf

Here the substituents have the following meanings:

$R^3$, $R^{3'}$, $R^4$ and $R^{4'}$ are each hydrogen;

$C_1$–$C_{10}$-alkyl whose carbon chain may be interrupted by from one to three oxygen atoms in ether function and which may bear the following substituents: cyano, hydroxyl, phenyl, phenoxy, phenylaminocarbonyloxy, benzyloxy, benzoyloxy, which may have $C_1$–$C_4$-alkyl, $C_1$–$C_4$-alkoxy, fluorine, chlorine or bromine as substituents, $C_1$–$C_4$-alkanoyloxy, $C_1$–$C_6$-alkoxycarbonyloxy, $C_1$–$C_8$-alkoxycarbonyl, mono- or di-$C_1$–$C_8$-alkylaminocarbonyloxy, in the last three of which the carbon chain may be interrupted by one or two oxygen atoms in ether function;

$C_3$–$C_5$-alkenyl or $C_5$–$C_7$-cycloalkyl; phenyl which may be substituted by $C_1$–$C_4$-alkyl, $C_1$–$C_4$-alkoxy, $C_1$–$C_4$-dialkylamino, acetylamino, fluorine, chlorine or bromine;

$R^5$ is hydrogen; chlorine;

$C_1$–$C_4$-alkyl, $C_1$–$C_4$-alkoxy, $C_1$–$C_4$-alkanoylamino, which may have $C_1$–$C_4$-alkoxy, phenoxy or chlorine as substituents, $C_2$–$C_3$-alkenoylamino, benzoylamino, ureido, mono- or di-$C_1$–$C_4$-alkylureido or $C_1$–$C_4$-alkylsulfonylamino;

$R^6$ is hydrogen, chlorine, $C_1$–$C_4$-alkyl or $C_1$–$C_4$-alkoxy;

$R^7$ is hydrogen, $C_1$–$C_8$-alkyl or phenyl;

$R^8$ is hydrogen, $C_1$–$C_8$-alkyl, which may have phenyl, furyl or thienyl as substituents, $C_5$–$C_7$-cycloalkyl or phenyl.

Suitable alkyl $R^3$, $R^{3'}$, $R^4$, $R^{4'}$, $R^5$, $R^6$, $R^7$ or $R^8$ is in particular methyl, ethyl, propyl, isopropyl, butyl, isobutyl, sec-butyl and tert-butyl.

Alkyls $R^3$, $R^{3'}$, $R^4$, $R^{4'}$, $R^7$ and $R^8$ may each also be for example pentyl, isopentyl, neopentyl, tert-pentyl, hexyl, 2-methylpentyl, heptyl, octyl and 2-ethylhexyl, while $R^3$, $R^{3'}$, $R^4$ and $R^{4'}$ may each additionally be for example nonyl or decyl.

If the carbon chain of alkyl $R^3$, $R^{3'}$, $R^4$ or $R^{4'}$ is interrupted by from one to three oxygen atoms, it may be for example: 2-methoxyethyl, 2-ethoxyethyl, 2-propoxyethyl, 2-butoxyethyl, 2- or 3-methoxypropyl, 1-methoxy-2-propyl, 2-ethoxypropyl, 2-propoxypropyl, 4,7-dioxaoctyl, 4,7-dioxanonyl, 4,8-dioxadecyl, 4,7,10-trioxaundecyl or 4,7,10-trioxadodecyl.

Alkyl $R^3$, $R^{3'}$, $R^4$ or $R^{4'}$ may additionally have cyano and hydroxyl as substituents; corresponding examples are:

cyanomethyl, 2-cyanoethyl and 3-cyanopropyl, 2-hydroxyethyl, 2-hydroxypropyl, 1-hydroxyprop-2-yl, 2-hydroxybutyl, 1-hydroxybut-2-yl, 4-hydroxybutyl and 8-hydroxy-4-oxaoctyl.

Other suitable alkyls $R^3$, $R^{3'}$, $R^4$ and $R^{4'}$ have phenyl, phenoxy, phenylaminocarbonyloxy and also benzyloxy or benzoyloxy as substituents, for example:

benzyl, 1-phenylethyl, 2-phenylethyl, 2-phenoxyethyl, 6-phenoxy-4-oxahexyl, 2-(phenylaminocarbonyloxy)ethyl, 3-benzyloxypropyl, 2-benzoyloxyethyl, 2-(2-methylbenzoyloxy)ethyl, 2-(4-methylbenzoyloxy)ethyl, 2-(4-chlorobenzoyloxy)ethyl, 2-(4-methoxybenzoyloxy)ethyl, 2-benzoyloxypropyl or 2-benzyloxybutyl.

If alkyl $R^3$, $R^{3'}$, $R^4$ or $R^{4'}$ is substituted by alkanoyloxy, alkoxycarbonyloxy, alkoxycarbonyl or alkylaminocarbonyloxy, the resulting groups are for example:

2-acetyloxyethyl, 2-propionyloxyethyl, 2-pentanoyloxyethyl, 2-acetyloxypropyl, 3-acetyloxypropyl, 2-propionyloxypropyl, 2-acetyloxybutyl, 4-acetyloxybutyl, 2-propionyloxybutyl and 8-acetyloxy-4-oxaoctyl;

2-(ethoxycarbonyloxy)ethyl, 2-(butoxycarbonyloxy)ethyl and 4-(ethoxycarbonyloxy)butyl;

methoxycarbonylmethyl, ethoxycarbonylmethyl, propoxycarbonylmethyl, butoxycarbonylmethyl, 1-(methoxycarbonyl)ethyl, 2-(methoxycarbonyl)ethyl, 2-(ethoxycarbonyl)ethyl, 2-(propoxycarbonyl)ethyl, 2-(butoxycarbonyl)ethyl, 2-(isobutoxycarbonyl)ethyl, 2-(2-ethylhexyloxycarbonyl)ethyl, 2-(3-oxabutyloxycarbonyl)ethyl, 2-(3-oxapentyloxycarbonyl)ethyl and 2-(3-oxaheptyloxycarbonyl)ethyl;

2-(diethylaminocarbonyloxy)ethyl.

Alkenyl, cycloalkyl or substituted phenyl $R^3$, $R^{3'}$, $R^4$ or $R^{4'}$ is for example:

allyl or methallyl;

cyclopentyl, cyclohexyl, methylcyclohexyl or cycloheptyl; 2-, 3- or 4-methylphenyl, 2- or 4-methoxyphenyl, 2- or 4-ethoxyphenyl, 4-dimethylaminophenyl, 4-acetylaminophenyl, 5-chlorophenyl or 2,4-dichlorophenyl.

Suitable alkoxy $R^5$ or $R^6$ is for example methoxy, ethoxy, propoxy, isopropoxy, butoxy or isobutoxy.

$R^5$ can also be for example alkanoylamino, alkenoylamino, benzoylamino, alkylureido or alkylsulfonylamino, such as:

acetylamino, propionylamino, methoxyacetylamino, ethoxyacetylamino, chloroacetylamino, phenoxyacetylamino;

acryloylamino or methacryloylamino; N-methylureido, N-butylureido or N,N-dimethylureido; methylsulfonylamino, ethylsulfonylamino, propylsulfonylamino or butylsulfonylamino.

$R^8$ can also be for example substituted alkyl such as benzyl, 1- or 2-phenylethyl, 2-furylmethyl, 2-(2-furyl-)ethyl, 2-(2-thienyl)ethyl or 2-(2-pyridyl)ethyl.

Of the abovementioned coupling components H-K, those of the formulae IIIa, IIIc, IIId, IIIe and IIIf are particularly preferred.

Very particularly preferred coupling components are aniline derivatives IIIa and tetrahydroquinoline derivatives IIIf where the substituents have the following meanings:

$R^3$ and $R^4$ are each hydrogen;

$C_1$–$C_8$-alkyl whose carbon chain may be interrupted by an oxygen atom and which may carry cyano, hydroxyl, $C_1$–$C_4$-alkanoyloxy or $C_1$–$C_8$-alkoxycarbonyl as substituents; or $C_5$–$C_7$-cycloalkyl;

$R^5$ is hydrogen, methyl, methoxy or acetylamino;

$R^6$ is hydrogen; and $R^7$ is methyl.

Preferred azo dyes I may be discerned in the Examples.

The dyes I to be used according to the present invention are notable for the following properties compared with prior art red and blue thermotransfer printing dyes: readier thermal transferability in spite of the higher molecular weight, improved migration properties in the receiving medium at room temperature, higher thermal stability, higher lightfastness, better resistance to moisture and chemicals, better solubility in printing ink preparation, higher color strength, and readier industrial accessability.

In addition, the azo dyes I exhibit a distinctly better purity of hue, in particular in mixtures of dyes, and produce improved black prints.

The transfer sheets required as dye donors for the thermotransfer printing process according to the present invention are prepared as follows. The azo dyes I are incorporated in an organic solvent, such as isobutanol, methyl ethyl ketone, methylene chloride, chlorobenzene, toluene, tetrahydrofuran or a mixture thereof, together with one or more binders and possibly further assistants such as release agents or crystallization inhibitors to form a printing ink in which the dyes are preferably present in a molecularly dispersed, ie. dissolved, form. The printing ink is then applied to an inert support and dried.

Suitable binders for the use of the azo dyes I according to the present invention are all materials which are soluble in organic solvents and which are known to be suitable for thermotransfer printing, eg. cellulose derivatives such as methylcellulose, hydroxypropylcellulose, cellulose acetate or cellulose acetobutyrate, but in particular ethylcellulose and ethylhydroxyethylcellulose, starch, alginates, alkyd resins and vinyl resins such as polyvinyl alcohol or polyvinylpyrrolidone but in particular polyvinyl acetate and polyvinyl butyrate. It is also possible to use polymers and copolymers of acrylates and derivatives thereof, such as polyacrylic acid, polymethyl methacrylate or styrene/acrylate copolymers, polyester resins, polyamide resins, polyurethane resins or natural resins such as gum arabic.

It is frequently advisable to use mixtures of these binders, for example mixtures of ethylcellulose and polyvinyl butyrate in a weight ratio of 2 : 1.

The weight ratio of binder to dye is in general from 8 : 1 to 1 : 1, preferably from 5 : 1 to 2 : 1.

Suitable assistants are for example release agents based on perfluorinated alkylsulfonamidoalkyl esters or silicones as described in EP-A-227,092 and EP-A-192,435, and in particular organic additives which stop the transfer dyes from crystallizing out in the course of storage or heating of the inked ribbon, for example cholesterol or vanillin.

Inert support materials are for example tissue, blotting or parchment paper and films made of heat resistant plastics such as polyesters, polyamides or polyimides, which films may also be metal coated.

The inert support may additionally be coated on the side facing the thermal printing head with a lubricant in order that adhesion of the thermal printing head to the support material may be prevented. Suitable lubricants are for example silicones or polyurethanes as described in EP-A-216,483.

The thickness of the support is in general from 3 to 30 μm, preferably from 5 to 10 μm.

The substrate to be printed, eg. paper, must in turn be coated with a binder which receives the dye during the printing process. It is preferable to use for this purpose polymeric materials whose glass transition temperatures $T_g$ are within the range from 50° to 100° C., eg. polycarbonates and polyesters. Details may be found in EP-A-227,094, EP-A-133,012, EP-A-133,011, JP-A-199,997/1986 or JP-A-283,595/1986.

The process according to the present invention is carried out using a thermal printing head which is heatable to above 300° C., so that dye transfer takes not more than 15 msec.

EXAMPLES

First, transfer sheets (donors) were produced in a conventional manner from a polyester sheet 8 μm in thickness coated with an approximately 5 μm thick transfer layer of a binder B which in each case contained about 0.25 g of azo dye I. The weight ratio of binder to dye was in each case 4 : 1.

The substrate (receiver) to be printed was paper about 120 μm in thickness which had been coated with a layer of plastic 8 μm in thickness (Hitachi Color Video Print Paper).

Donor and receiver were placed on top of one another with the coated fronts next to each other then wrapped in aluminum foil and heated between two hotplates at 70°–80° C. for 2 minutes. This operation was repeated three times with similar samples at a temperature within the range from 80° to 120° C., the temperature being increased each time.

The amount of dye diffusing into the plastics layer of the receiver in the course of transfer is proportional to the optical density determined photometrically as absorbance A after each heating phase at the abovementioned temperatures.

The plot of the logarithm of the measured absorbances A against the corresponding reciprocal of the absolute temperature is a straight line from whose slope it is possible to calculate the activation energy $\Delta E_T$ for the transfer experiment:

CA=cellulose acetate) and the previously mentioned parameters T* [°C.]and $\Delta E_T$ [kcal/mol].

TABLE 1a

IIIa

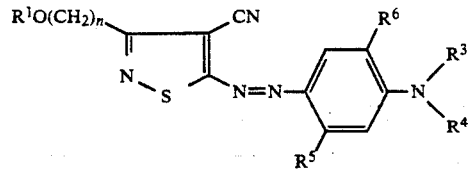

| Ex. | $R^1$ | n | $R^3$ | $R^4$ | $R^5$ | $R^6$ | Hue |
|---|---|---|---|---|---|---|---|
| 1 | $-CH_3$ | 2 | $-C_4H_9$ | $-CH(CH_3)-C_2H_5$ | $-NH-CO-CH_3$ | $-H$ | violet |
| 2 | $-CH_3$ | 2 | $-C_3H_7$ | $-C_3H_7$ | $-NH-CO-CH_3$ | $-H$ | violet |
| 3 | $-CH_3$ | 2 | $-C_6H_{13}$ | $-C_2H_5$ | $-O-CH_3$ | $-H$ | violet |
| 4 | $-CH_3$ | 2 | $-H$ | $-C_4H_9$ | $-CH_3$ | $-O-CH_3$ | violet |
| 5 | $-CH_3$ | 2 | $-C_2H_5$ | $-C_2H_5$ | $-H$ | $-H$ | violet |
| 6 | $-CH_3$ | 2 | $-(CH_2)_2-O-CH_3$ | $-(CH_2)_2-O-CH_3$ | $-H$ | $-H$ | violet |
| 7 | $-CH_3$ | 2 | $-(CH_2)_2-O-CO-CH_3$ | $-(CH_2)_2-O-CO-CH_3$ | $-CH_3$ | $-H$ | bluish red |
| 8 | $-CH_3$ | 2 | $-(CH_2)_2-Ph$ | $-(CH_2)_2-CN$ | $-H$ | $-H$ | red |
| 9 | $-CH_3$ | 2 | $-(CH_2)_2-O-CO-C_2H_5$ | $-(CH_2)_2-O-CO-C_2H_5$ | $-Cl$ | $-H$ | red |
| 10 | $-CH_3$ | 2 | $-(CH_2)_2-O-CO-C_2H_5$ | $-(CH_2)_2-CN$ | $-H$ | $-H$ | red |
| 11 | $-CH_3$ | 2 | $-(CH_2)_2-CN$ | $-(CH_2-CH=CH_2$ | $-H$ | $-H$ | red |
| 12 | $-CH_3$ | 2 | $-(CH_2)_2-O-CO-CH_3$ | $-(CH_2)_2-O-CO-CH_3$ | $-CH_3$ | $-O-CH_3$ | violet |
| 13 | $-CH_3$ | 2 | $-CH_2-CH=CH_2$ | $-CH_2-CH=CH_2$ | $-NH-CO-CH_3$ | $-O-CH_3$ | reddish blue |
| 14 | $-CH_3$ | 2 | $-(CH_2)_2-CO-O-(CH_2)_2-O-C_2H_5$ | $-C_2H_5$ | $-H$ | $-H$ | red |
| 15 | $-CH_3$ | 2 | $-(CH_2)_2-CN$ | $-C_2H_5$ | $-CH_3$ | $-H$ | bluish red |
| 16 | $-CH_3$ | 2 | $-(CH_2)_2-CO-O-CH_3$ | $-C_2H_5$ | $-H$ | $-H$ | red |
| 17 | $-CH_3$ | 2 | $-(CH_2)_2-OH$ | $-C_4H_9$ | $-CH_3$ | $-H$ | violet |
| 18 | $-CH_3$ | 2 | $-C_2H_5$ | $-C_2H_5$ | $-NH-CO-CH_3$ | $-H$ | violet |
| 19 | $-CH_3$ | 2 | $-(CH_2)_2-O-CO-CH_3$ | $-C_2H_5$ | $-CH_3$ | $-H$ | violet |
| 20 | $-CH_3$ | 2 | $-(CH_2)_2-O-CO-CH_3$ | $-(CH_2)_2-O-CO-CH_3$ | $-H$ | $-H$ | red |
| 21 | $-C_2H_5$ | 2 | $-(CH_2)_2-CN$ | $-C_2H_5$ | $-CH_3$ | $-H$ | bluish red |
| 22 | $-C_2H_5$ | 2 | $-CH_2-Ph$ | $-(CH_2)_2-CO-O-CH_3$ | $-H$ | $-H$ | red |
| 23 | $-C_2H_5$ | 2 | $-C_2H_5$ | $-C_2H_5$ | $-H$ | $-H$ | violet |
| 24 | $-C_4H_9$ | 2 | $-C_2H_5$ | $-C_2H_5$ | $-H$ | $-H$ | red |
| 25 | $-CH_3$ | 1 | $-(CH_2)_2-CN$ | $-C_2H_5$ | $-CH_3$ | $-H$ | bluish red |
| 26 | $-CH_3$ | 1 | $-(CH_2)_2-CO-O-CH_3$ | $-C_2H_5$ | $-H$ | $-H$ | red |
| 27 | $-CH_3$ | 1 | $-(CH_2)_2-OH$ | $-C_4H_9$ | $-CH_3$ | $-H$ | violet |
| 28 | $-C_4H_9$ | 2 | $-C_2H_5$ | $-C_2H_5$ | $-NH-CO-CH_3$ | $-H$ | violet |
| 29 | $-C_4H_9$ | 2 | $-(CH_2)_2-O-CO-CH_3$ | $-C_2H_5$ | $-CH_3$ | $-H$ | violet |
| 30 | $-C_4H_9$ | 2 | $-(CH_2)_2-O-CO-CH_3$ | $-(CH_2)-O-CO-CH_3$ | $-H$ | $-H$ | red |
| 31 | $-C_4H_9$ | 2 | $-C_4H_9$ | $-(CH_2)_2-CN$ | $-H$ | $-H$ | red |
| 32 | $-C_4H_9$ | 2 | $-CH_2-Ph$ | $-(CH_2)_2-CO-O-C_4H_9$ | $-H$ | $-H$ | red |

$$\Delta E_T = 2.3 \times R \times \frac{\Delta \log A}{\Delta\left[\frac{1}{T}\right]}$$

*R:* general gas constant

From the plot it is additionally possible to discern the temperature T* at which the absorbance attains the value 2, ie. at which the transmitted light intensity is one hundredth of the incident light intensity. The lower the temperature T*, the better the thermal transferability of the particular dye.

Tables la to 9a list the azo dyes I which were studied in respect of their thermal transfer characteristics together with their hues.

The related Tables 1b to 9b list the particular binder B used employing the following abbreviations: EC=ethylcellulose, PVB=polyvinyl butyrate, MIX=EC:PVB=2:1, EHEC=ethylhydroxyethylcellulose, TABLE 2a IIIc

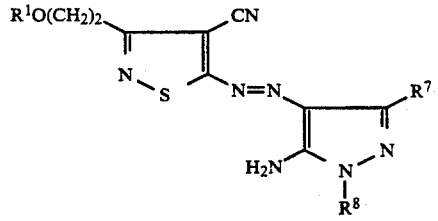

| Ex. | $R^1$ | $R^7$ | $R^8$ | Hue |
|---|---|---|---|---|
| 33 | $-CH_3$ | $-H$ | Cyclohexyl | yellowish orange |
| 34 | $-CH_3$ | $-H$ | $-Ph$ | yellowish orange |
| 35 | $-CH_3$ | $-H$ | Fur-2-ylmethyl | yellowish orange |
| 36 | $-CH_3$ | $-CH_3$ | $-Ph$ | yellowish orange |
| 37 | $-C_2H_5$ | $-H$ | $-CH_2-Ph$ | yellowish orange |
| 38 | $-C_2H_5$ | $-H$ | Cyclohexyl | yellowish orange |
| 39 | $-C_4H_9$ | $-H$ | Cyclohexyl | yellowish orange |
| 40 | $-C_4H_9$ | $-H$ | $-Ph$ | yellowish orange |
| 41 | $-C_4H_9$ | $-CH_3$ | Fur-2-ylmethyl | yellowish orange |

TABLE 3a

IIId

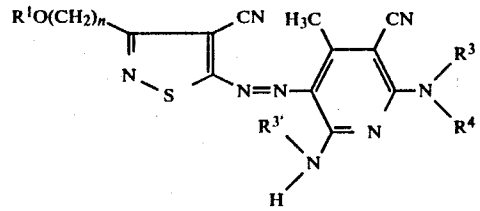

| Ex. | $R^1$ | n | $R^{3'}$ | $R^3$ | $R^4$ | Hue |
|---|---|---|---|---|---|---|
| 42 | $-CH_3$ | 2 | $-H$ | $-H$ | $-(CH_2)_3-O-(CH_2)_2-O-CH_3$ | reddish orange |
| 43 | $-C_2H_5$ | 2 | $-H$ | $-H$ | $-(CH_2)_3-O-(CH_2)_2-O-C_2H_5$ | reddish orange |
| 44 | $-CH_3$ | 2 | $-H$ | $-H$ | $-(CH_2)_3-O-[(CH_2)_2-O]_2-C_2H_5$ | reddish orange |
| 45 | $-CH_3$ | 2 | $-H$ | $-H$ | $-(CH_2)_3-O-(CH_2)_4-O-CO-CH_3$ | reddish orange |
| 46 | $-CH_3$ | 2 | $-(CH_2)_3-O-CH_3$ | $-(CH_2)_2-O-CH_3$ | $-(CH_2)_2-O-CH_3$ | red |
| 47 | $-CH_3$ | 2 | $-CH(C_2H_5)-CH_2-O-CO-CH_3$ | $-(CH_2)_2-O-CH_3$ | $-(CH_2)_2-O-CH_3$ | red |
| 48 | $-CH_3$ | 2 | $-(CH_2)_3-O-CH_3$ | $-(CH_2)_2-O-CO-CH_3$ | $-C_2H_5$ | red |
| 49 | $-C_2H_5$ | 2 | $-(CH_2)_3-O-(CH_2)_2-O-CH_3$ | $-H$ | $-H$ | reddish orange |
| 50 | $-CH_3$ | 2 | $-(CH_2)_3-O-[(CH_2)_2-O]_2-C_2H_5$ | $-H$ | $-H$ | reddish orange |
| 51 | $-CH_3$ | 2 | $-(CH_2)_3-O-[(CH_2)_2-O]_2-C_2H_5$ | $-(CH_2)_3-O-CH_3$ | $-H$ | red |
| 52 | $-CH_3$ | 2 | $-(CH_2)_3-O-[(CH_2)_2-O]_2-CH_3$ | $-Ph$ | $-H$ | pink |
| 53 | $-CH_3$ | 2 | $-(CH_2)_3-O-[(CH_2)_2-O]_2-CH_3$ | $-Ph\text{-}2\text{-}O-CH_3$ | $-H$ | pink |
| 54 | $-CH_3$ | 2 | $-C_2H_5$ | $-(CH_2)_3-O-[(CH_2)_2-O]_2-CH_3$ | $-H$ | red |
| 55 | $-CH_3$ | 2 | $-C_2H_5$ | $-(CH_2)_3-O-(CH_2)_4-OH$ | $-H$ | red |
| 56 | $-C_4H_9$ | 2 | $-(CH_2)_2-O-CH_3$ | $-(CH_2)_3-O-(CH_2)_4-OH$ | $-H$ | red |
| 57 | $-CH_3$ | 2 | $-(CH_2)_3-O-CH_3$ | $-(CH_2)_3-O-(CH_2)_4-OH$ | $-H$ | red |
| 58 | $-CH_3$ | 2 | $-(CH_2)_3-O-CO-CH_3$ | $-(CH_2)_3-O-(CH_2)_2-O-C_2H_5$ | $-H$ | red |
| 59 | $-CH_3$ | 2 | $-C_2H_5$ | $-(CH_2)_2-O-CH_3$ | $-(CH_2)_2-O-CH_3$ | red |
| 60 | $-CH_3$ | 2 | $-(CH_2)_3-O-(CH_2)_2-O-CH_3$ | $-Ph\text{-}2\text{-}O-CH_3$ | $-H$ | red |
| 61 | $-CH_3$ | 2 | $-(CH_2)_2-O-CH_3$ | $-(CH_2)_2-O-CH_3$ | $-H$ | red |
| 62 | $-C_2H_5$ | 2 | $-H$ | $-H$ | $-(CH_2)_3-O-(CH_2)_2-O-CH_3$ | reddish orange |
| 63 | $-CH_3$ | 1 | $-H$ | $-H$ | $-(CH_2)_3-O-(CH_2)_2-O-C_2H_5$ | reddish orange |
| 64 | $-C_4H_9$ | 2 | $-H$ | $-H$ | $-(CH_2)_3-O-](CH_2)_2-O]_2-C_2H_5$ | reddish orange |
| 65 | $-C_3H_7$ | 2 | $-H$ | $-H$ | $-(CH_2)_3-O-(CH_2)_4-O-CO-CH_3$ | reddish orange |
| 66 | $-C_2H_5$ | 1 | $-(CH_2)_3-O-CH_3$ | $-(CH_2)_2-O-CH_3$ | $-(CH_2)_2-O-CH_3$ | red |
| 67 | $-CH_3$ | 1 | $-CH(C_2H_5)-CH_2-O-CO-CH_3$ | $-(CH_2)_2-O-CH_3$ | $-(CH_2)_2-O-CH_3$ | red |
| 68 | $-C_4H_9$ | 2 | $-(CH_2)_3-O-CH_3$ | $-(CH_2)_2-O-CO-CH_3$ | $-C_2H_5$ | red |
| 69 | $-C_4H_9$ | 2 | $-(CH_2)_3-O-(CH_2)_2-O-Ph$ | $-(CH_2)_2-O-CH_3$ | $-(CH_2)_2-O-CH_3$ | red |

TABLE 4a

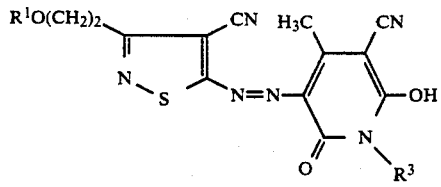

IIIe

| Ex. | $R^1$ | $R^3$ | Hue |
|---|---|---|---|
| 70 | $-CH_3$ | $-C_2H_5$ | yellow |
| 71 | $-CH_3$ | $-C_4H_9$ | yellow |

TABLE 4a-continued

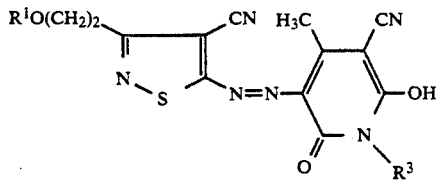

IIIe

| Ex. | $R^1$ | $R^3$ | Hue |
|---|---|---|---|
| 72 | $-CH_3$ | $-(CH_2)_3-O-(CH_2)_2-O-Ph$ | yellow |

TABLE 5a

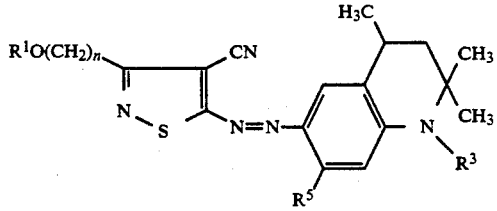

IIIf

| Ex. | $R^1$ | n | $R^3$ | $R^5$ | Hue |
|---|---|---|---|---|---|
| 73 | $-CH_3$ | 2 | $-C_2H_5$ | $-H$ | violet |
| 74 | $-C_2H_5$ | 2 | $-C_3H_7$ | $-H$ | violet |
| 75 | $-CH_3$ | 2 | $-C_4H_9$ | $-CH_3$ | violet |
| 76 | $-CH_3$ | 2 | $-(CH_2)_2-O-C_4H_9$ | $-NH-CO-CH_3$ | violet |
| 77 | $-C_4H_9$ | 1 | $-C_2H_5$ | $-CH_3$ | violet |
| 78 | $-CH_3$ | 2 | $-(CH_2)_2-O-CH_3$ | $-H$ | violet |
| 79 | $-C_4H_9$ | 2 | $-C_2H_5$ | $-H$ | violet |
| 80 | $-CH_3$ | 2 | $-H$ | $-H$ | bluish red |
| 81 | $-C_6H_{13}$ | 2 | $-C_4H_9$ | $-CH_3$ | violet |
| 82 | $-CH_3$ | 2 | $-(CH_2)_2-CO-O-CH_2-OH$ | $-CH_3$ | violet |
| 83 | $-C_2H_5$ | 1 | $-(CH_2)_2-CN$ | $-NH-CO-CH_3$ | violet |
| 84 | $-CH_3$ | 1 | $-CH_2-O-(CH_2)_2-O-Ph$ | $-NH-CO-CH_3$ | violet |
| 85 | $-CH_3$ | 1 | $-C_2H_5$ | $-NH-SO-O-C_4H_9$ | violet |
| 86 | $-C_2H_5$ | 2 | $-(CH_2)_2-O-CO-C_6H_{13}$ | $-NH-SO-O-C_2H_5$ | violet |
| 87 | $-CH_3$ | 1 | $-(CH_2)_2-O-CO-C_3H_7$ | $-NH-CO-C_4H_9$ | violet |

TABLE 6a

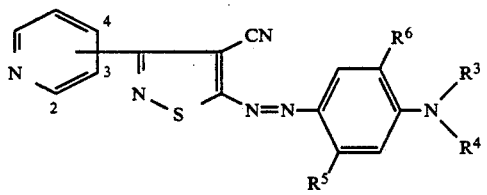

IIIa

| Ex. | Position of pyridyl group | $R^3$ | $R^4$ | $R^5$ | $R^6$ | Hue |
|---|---|---|---|---|---|---|
| 88 | 3 | $-(CH_2)_2-CN$ | $-C_2H_5$ | $-CH_3$ | $-H$ | red |
| 89 | 3 | $-(CH_2)_2-CO-O-CH_3$ | $-C_2H_5$ | $-H$ | $-H$ | red |
| 90 | 3 | $-(CH_2)_2-OH$ | $-C_4H_9$ | $-CH_3$ | $-H$ | red |
| 91 | 3 | $-C_2H_5$ | $-C_2H_5$ | $-NH-CO-CH_3$ | $-H$ | pink |
| 92 | 3 | $-(CH_2)_2-O-CO-CH_3$ | $-C_2H_5$ | $-CH_3$ | $-H$ | red |
| 93 | 3 | $-(CH_2)_2-O-CO-CH_3$ | $-(CH_2)_2-O-CO-CH_3$ | $-H$ | $-H$ | red |
| 94 | 3 | $-C_2H_5$ | $-C_2H_5$ | $-H$ | $-H$ | red |
| 95 | 3 | $-(CH_2)_2-O-CH_3$ | $-(CH_2)_2-O-CH_3$ | $-H$ | $-H$ | red |
| 96 | 3 | $-(CH_2)_2-O-CO-CH_3$ | $-(CH_2)_2-O-CO-CH_3$ | $-CH_3$ | $-H$ | red |
| 97 | 3 | $-(CH_2)_2-Ph$ | $-(CH_2)_2-CN$ | $-H$ | $-H$ | red |
| 98 | 3 | $-(CH_2)_2-O-CO-C_2H_5$ | $-(CH_2)_2-O-C_2H_5$ | $-Cl$ | $-H$ | red |
| 99 | 3 | $-(CH_2)_2-O-CO-C_2H_5$ | $-(CH_2)_2-CN$ | $-H$ | $-H$ | red |
| 100 | 3 | $-(CH_2)_2-CN$ | $-CH_2-CH=CH_2$ | $-H$ | $-H$ | red |
| 101 | 3 | $-(CH_2)_2-O-CO-CH_3$ | $-(CH_2)_2-O-CO-CH_3$ | $-CH_3$ | $-O-CH_3$ | violet |
| 102 | 3 | $-CH_2-CH=CH_2$ | $-CH_2-CH=CH_2$ | $-NH-CO-CH_3$ | $-O-CH_3$ | bluish violet |
| 103 | 3 | $-(CH_2)_2-CO-O-(CH_2)_2-O-C_2H_5$ | $-C_2H_5$ | $-H$ | $-H$ | red |
| 104 | 4 | $-(CH_2)_2-CN$ | $-C_2H_5$ | $-CH_3$ | $-H$ | red |
| 105 | 4 | $-CH_2-Ph$ | $-(CH_2)_2-CO-O-CH_3$ | $-H$ | $-H$ | red |
| 106 | 4 | $-C_2H_5$ | $-C_2H_5$ | $-H$ | $-H$ | red |

TABLE 6a-continued

IIIa

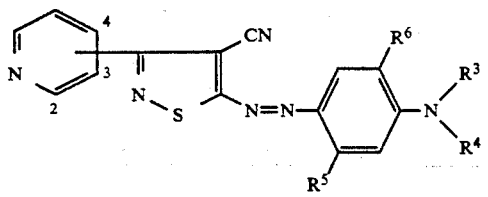

| Ex. | Position of pyridyl group | $R^3$ | $R^4$ | $R^5$ | $R^6$ | Hue |
|---|---|---|---|---|---|---|
| 107 | 2 | $-(CH_2)_2-CN$ | $-C_2H_5$ | $-H$ | $-H$ | red |

TABLE 7a

IIIc

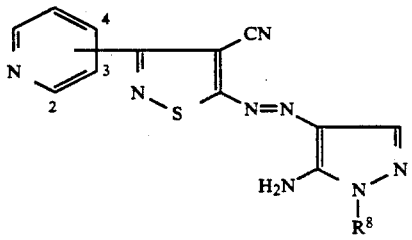

| Ex. | Position of pyridyl group | $R^8$ | Hue |
|---|---|---|---|
| 108 | 3 | Cyclohexyl | yellowish orange |
| 109 | 3 | $-Ph$ | yellowish orange |
| 110 | 3 | Fur-2-ylmethyl | yellowish orange |

TABLE 7a-continued

IIIc

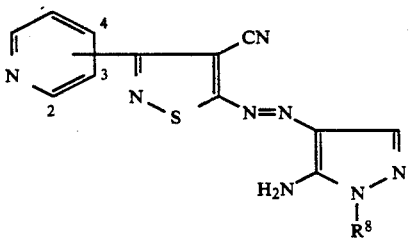

| Ex. | Position of pyridyl group | $R^8$ | Hue |
|---|---|---|---|
| 111 | 4 | $-Ph$ | yellowish orange |
| 112 | 4 | $-CH_2-Ph$ | yellowish orange |

TABLE 8a

IIId

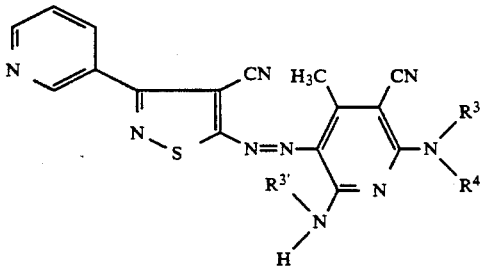

| Ex. | $R^{3'}$ | $R^3$ | $R^4$ | Hue |
|---|---|---|---|---|
| 113 | $-H$ | $-H$ | $-(CH_2)_3-O-(CH_2)_2-O-CH_3$ | reddish orange |
| 114 | $-H$ | $-H$ | $-(CH_2)_3-O-(CH_2)_2-O-C_2H_5$ | reddish orange |
| 115 | $-H$ | $-H$ | $-(CH_2)_3-O-[(CH_2)_2-O]_2-C_2H_5$ | reddish orange |
| 116 | $-H$ | $-H$ | $-(CH_2)_3-O-(CH_2)_4-O-CO-CH_3$ | reddish orange |
| 117 | $-(CH_2)_3-O-CH_3$ | $-(CH_2)_2-O-CH_3$ | $-(CH_2)_2-O-CH_3$ | red |
| 118 | $-CH(C_2H_5)-CH_2-O-CO-CH_3$ | $-(CH_2)_2-O-CH_3$ | $-(CH_2)_2-O-CH_3$ | red |
| 119 | $-(CH_2)_3-O-CH_3$ | $-(CH_2)_2-O-CO-CH_3$ | $-C_2H_5$ | red |
| 120 | $-(CH_2)_3-O-(CH_2)_2-O-CH_3$ | $-H$ | $-H$ | reddish orange |
| 121 | $-(CH_2)_3-O-[(CH_2)_2-O]_2-C_2H_5$ | $-H$ | $-H$ | reddish orange |
| 122 | $-(CH_2)_3-O-[(CH_2)_2-O]_2-C_2H_5$ | $-(CH_2)_3-O-CH_3$ | $-H$ | red |
| 123 | $-(CH_2)_3-O-[(CH_2)_2-O]_2-CH_3$ | $-Ph$ | $-H$ | red |
| 124 | $-(CH_2)_3-O-[(CH_2)_2-O]_2-CH_3$ | $-Ph\text{-}2\text{-}O-CH_3$ | $-H$ | red |
| 125 | $-C_2H_5$ | $-(CH_2)_3-O-[(CH_2)_2-O]_2-CH_3$ | $-C_4H_9$ | pink |
| 126 | $-C_2H_5$ | $-(CH_2)_3-O-(CH_2)_4-OH$ | $-H$ | red |
| 127 | $-(CH_2)_2-O-CH_3$ | $-(CH_2)_3-O-(CH_2)_4-OH$ | $-C_2H_5$ | pink |
| 128 | $-(CH_2)_3-O-CH_3$ | $-(CH_2)_3-O-(CH_2)_4-OH$ | $-H$ | red |
| 129 | $-(CH_2)_3-O-CO-CH_3$ | $-(CH_2)_3-O-(CH_2)_2-O-C_2H_5$ | $-H$ | red |

TABLE 9a

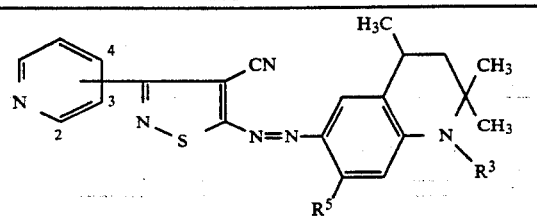

| Ex. | Position of pyridyl group | $R^3$ | $R^5$ | Hue |
|---|---|---|---|---|
| 130 | 3 | $-C_3H_7$ | $-H$ | violet |
| 131 | 3 | $-C_2H_5$ | $-CH_3$ | violet |
| 132 | 3 | $-C_4H_9$ | $-NH-CO-CH_3$ | violet |
| 133 | 3 | $-(CH_2)_2-O-C_4H_9$ | $-NH-CO-CH_3$ | violet |
| 134 | 2 | $-C_6H_{13}$ | $-CH_3$ | violet |
| 135 | 3 | $-(CH_2)_2-CO-O-C_7H_{15}$ | $-NH-CO-CH_3$ | violet |
| 136 | 3 | $-(CH_2)_2-O-CO-C_6H_{13}$ | $-NH-CO-CH_3$ | violet |
| 137 | 3 | $-(CH_2)_4-CH(CH_3)-C_2H_5$ | $-CH_3$ | violet |
| 138 | 3 | $-C_3H_7$ | $-O-CH_3$ | violet |
| 139 | 3 | $-[(CH_2)_2-O]_2-C_4H_9$ | $-NH-CO-CH_3$ | violet |
| 140 | 3 | $-(CH_2)_4-OH$ | $-NH-CO-CH_3$ | violet |
| 141 | 3 | $-(CH_2)_2-OH$ | $-CH_3$ | violet |
| 142 | 2 | $-(CH_2)_2-CN$ | $-NH-CO-C_4H_9$ | violet |
| 143 | 3 | $-C_4H_9$ | $-H$ | violet |
| 144 | 3 | $-C_7H_{15}$ | $-H$ | violet |
| 145 | 3 | $-H$ | $-H$ | violet |
| 146 | 2 | $-H$ | $-CH_3$ | violet |
| 147 | 3 | $-H$ | $-C_2H_5$ | violet |

TABLE 1b

THERMOTRANSFER DATA RELATING TO TABLE 1a

| Example | B | T*[°C.] | $\Delta E_T \left[\frac{kcal}{mol}\right]$ |
|---|---|---|---|
| 1 | EC | 82 | 16 |
| 2 | EC | 93 | 14 |
| 3 | EC | 100 | 15 |
| 4 | EC | 90 | 17 |
| 5 | EC | 80 | 16 |
| 6 | EC | 82 | 17 |
| 7 | EC | 86 | 17 |
| 8 | EC | 89 | 19 |
| 9 | EC | 80 | 23 |
| 10 | EC | 90 | 16 |
| 11 | EC | 98 | 15 |
| 12 | EHE | 96 | 19 |
| 13 | CA | 100 | 19 |
| 14 | EC | 102 | 21 |
| 15 | EHE | 98 | 19 |
| 16 | EC | 91 | 18 |
| 17 | EC | 93 | 20 |
| 18 | EC | 95 | 16 |
| 19 | EC | 92 | 17 |
| 20 | EC | 95 | 16 |
| 21 | CA | 93 | 12 |
| 22 | MIX | 96 | 13 |
| 23 | MIX | 97 | 15 |
| 24 | MIX | 101 | 17 |
| 25 | MIX | 99 | 19 |
| 26 | MIX | 88 | 18 |
| 27 | MIX | 91 | 19 |
| 28 | MIX | 93 | 17 |
| 29 | MIX | 85 | 19 |
| 30 | MIX | 94 | 18 |
| 31 | EC | 90 | 16 |
| 32 | EHE | 90 | 20 |

TABLE 2b

THERMOTRANSFER DATA RELATING TO TABLE 2a

| Example | B | T*[°C.] | $\Delta E_T \left[\frac{kcal}{mol}\right]$ |
|---|---|---|---|
| 33 | MIX | 97 | 13 |
| 34 | EHE | 88 | 17 |

TABLE 2b-continued

THERMOTRANSFER DATA RELATING TO TABLE 2a

| Example | B | T*[°C.] | $\Delta E_T \left[\frac{kcal}{mol}\right]$ |
|---|---|---|---|
| 35 | CA | 99 | 16 |
| 36 | MIX | 99 | 19 |
| 37 | MIX | 99 | 19 |
| 38 | MIX | 89 | 21 |
| 39 | MIX | 88 | 19 |
| 40 | MIX | 99 | 17 |
| 41 | MIX | 86 | 16 |

TABLE 3b

THERMOTRANSFER DATA RELATING TO TABLE 3a

| Example | B | T*[°C.] | $\Delta E_T \left[\frac{kcal}{mol}\right]$ |
|---|---|---|---|
| 42 | EC | 106 | 16 |
| 43 | EC | 98 | 17 |
| 44 | EHE | 80 | 20 |
| 45 | CA | 94 | 19 |
| 46 | EC | 93 | 11 |
| 47 | EC | 82 | 12 |
| 48 | EC | 91 | 16 |
| 49 | EC | 98 | 17 |
| 50 | EC | 85 | 18 |
| 51 | EC | 99 | 19 |
| 52 | EC | 96 | 17 |
| 53 | MIX | 97 | 19 |
| 54 | MIX | 93 | 18 |
| 55 | MIX | 100 | 19 |
| 56 | MIX | 100 | 18 |
| 57 | MIX | 99 | 19 |
| 58 | MIX | 89 | 13 |
| 59 | EC | 99 | 19 |
| 60 | EC | 88 | 19 |
| 61 | MIX | 99 | 20 |
| 62 | EC | 86 | 16 |
| 63 | EHE | 94 | 22 |
| 64 | MIX | 83 | 14 |
| 65 | MIX | 104 | 20 |
| 66 | MIX | 99 | 17 |
| 67 | MIX | 79 | 20 |
| 68 | EC | 99 | 13 |

TABLE 3b-continued

THERMOTRANSFER DATA RELATING TO TABLE 3a

| Example | B | T*[°C.] | $\Delta E_T \left[\frac{kcal}{mol}\right]$ |
|---|---|---|---|
| 69 | EC | 88 | 2 |

TABLE 4b

THERMOTRANSFER DATA RELATING TO TABLE 4a

| Example | B | T*[°C.] | $\Delta E_T \left[\frac{kcal}{mol}\right]$ |
|---|---|---|---|
| 70 | EC | 93 | 17 |
| 71 | MIX | 99 | 15 |
| 72 | MIX | 88 | 12 |

TABLE 5b

THERMOTRANSFER DATA RELATING TO TABLE 5a

| Example | B | T*[°C.] | $\Delta E_T \left[\frac{kcal}{mol}\right]$ |
|---|---|---|---|
| 73 | MIX | 97 | 21 |
| 74 | MIX | 95 | 19 |
| 75 | EC | 96 | 18 |
| 76 | EHE | 93 | 17 |
| 77 | MIX | 110 | 16 |
| 78 | MIX | 99 | 15 |
| 79 | EC | 106 | 20 |
| 80 | MIX | 99 | 21 |
| 81 | CA | 98 | 22 |
| 82 | MIX | 96 | 19 |
| 83 | MIX | 84 | 22 |
| 84 | EC | 94 | 13 |
| 85 | EHE | 90 | 14 |
| 86 | MIX | 99 | 17 |
| 87 | EC | 99 | 16 |

TABLE 6b

THERMOTRANSFER DATA RELATING TO TABLE 6a

| Example | B | T*[°C.] | $\Delta E_T \left[\frac{kcal}{mol}\right]$ |
|---|---|---|---|
| 88 | MIX | 89 | 16 |
| 89 | MIX | 89 | 20 |
| 90 | MIX | 99 | 19 |
| 91 | MIX | 98 | 20 |
| 92 | MIX | 99 | 19 |
| 93 | MIX | 96 | 18 |
| 94 | MIX | 99 | 22 |
| 95 | MIX | 98 | 19 |
| 96 | MIX | 80 | 18 |
| 97 | MIX | 99 | 22 |
| 98 | MIX | 89 | 19 |
| 99 | MIX | 99 | 18 |
| 100 | MIX | 109 | 17 |
| 101 | MIX | 107 | 16 |
| 102 | MIX | 96 | 21 |
| 103 | MIX | 89 | 19 |
| 104 | MIX | 98 | 18 |
| 105 | MIX | 84 | 17 |
| 106 | MIX | 94 | 19 |
| 107 | MIX | 95 | 14 |

TABLE 7b

THERMOTRANSFER DATA RELATING TO TABLE 7a

| Example | B | T*[°C.] | $\Delta E_T \left[\frac{kcal}{mol}\right]$ |
|---|---|---|---|
| 108 | MIX | 98 | 15 |
| 109 | MIX | 97 | 19 |

TABLE 7b-continued

THERMOTRANSFER DATA RELATING TO TABLE 7a

| Example | B | T*[°C.] | $\Delta E_T \left[\frac{kcal}{mol}\right]$ |
|---|---|---|---|
| 110 | MIX | 96 | 21 |
| 111 | MIX | 95 | 17 |
| 112 | MIX | 93 | 19 |

TABLE 8b

THERMOTRANSFER DATA RELATING TO TABLE 8a

| Example | B | T*[°C.] | $\Delta E_T \left[\frac{kcal}{mol}\right]$ |
|---|---|---|---|
| 113 | MIX | 99 | 17 |
| 114 | MIX | 99 | 16 |
| 115 | MIX | 89 | 19 |
| 116 | MIX | 97 | 19 |
| 117 | MIX | 86 | 18 |
| 118 | MIX | 99 | 17 |
| 119 | MIX | 98 | 16 |
| 120 | MIX | 95 | 15 |
| 121 | MIX | 97 | 19 |
| 122 | MIX | 96 | 18 |
| 123 | MIX | 99 | 14 |
| 124 | MIX | 98 | 19 |
| 125 | MIX | 85 | 13 |
| 126 | MIX | 101 | 19 |
| 127 | MIX | 98 | 18 |
| 128 | MIX | 87 | 17 |
| 129 | MIX | 96 | 20 |

TABLE 9b

THERMOTRANSFER DATA RELATING TO TABLE 9a

| Example | B | T*[°C.] | $\Delta E_T \left[\frac{kcal}{mol}\right]$ |
|---|---|---|---|
| 130 | EC | 88 | 15 |
| 131 | MIX | 97 | 16 |
| 132 | MIX | 97 | 17 |
| 133 | MIX | 96 | 19 |
| 134 | EC | 98 | 17 |
| 135 | EC | 89 | 22 |
| 136 | EHE | 95 | 17 |
| 137 | MIX | 104 | 18 |
| 138 | MIX | 98 | 19 |
| 139 | MIX | 89 | 18 |
| 140 | MIX | 97 | 16 |
| 141 | MIX | 96 | 13 |
| 142 | MIX | 95 | 14 |
| 143 | MIX | 92 | 17 |
| 144 | MIX | 90 | 18 |
| 145 | MIX | 111 | 19 |
| 146 | MIX | 89 | 18 |
| 147 | MIX | 98 | 19 |

We claim:

1. A process for transferring an azo dye by diffusion from a transfer to a plastic-coated substrate with the aid of a heat source, which comprises using for this purpose a transfer on which there is or are situated one or more azo dyes of the formula I

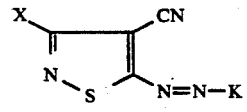

I in which the substituents have the following meanings:

X is a radical of the formula IIa or IIb $R^1—O—(CH_2)_n—$ or IIa

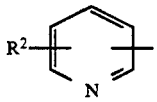

IIb where $R^1$ is hydrogen, $C_1$–$C_6$-alkyl, or phenyl which may be substituted by $C_1$–$C_4$-alkyl, $C_1$–$C_2$-alkoxy, chlorine, bromine or cyano, n is 1 or 2, and $R^2$ is hydrogen, $C_1$–$C_4$-alkyl, $C_1$–$C_4$-alkoxy, chlorine or bromine, and K is the radical of a coupling component III

H—K III of an aniline, aminoaphthaline, pyrazole, hydroxypyridone or tetrahydroquinoline.

2. A process as claimed in claim 1, wherein K is of: aniline derivatives of formula IIIa

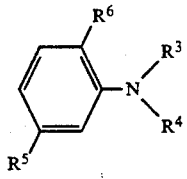

IIIa aminoaphthaline derivatives of the formula IIIb

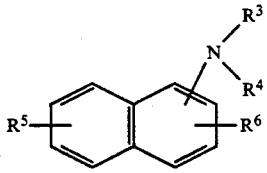

IIIb pyrazole derivatives of the formula IIIc

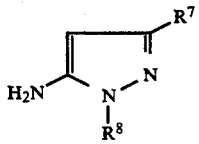

IIIc hydroxypyridone derivatives of the formula IIIe

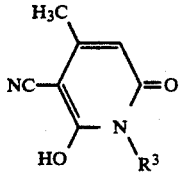

IIIe tetrahydroquinoline derivatives of the formula IIIf

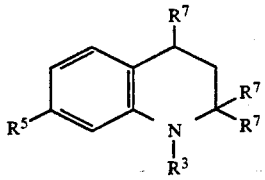

IIIf wherein $R^3$ and $R^4$ are each hydrogen;

$C_1$–$C_{10}$-alkyl whose carbon chain may be interrupted by from one to three oxygen atoms in ether function and which may bear the following substituents: cyano, hydroxyl, phenyl, phenoxy, phenylaminocarbonyloxy, benzyloxy, benzoyloxy, which may have $C_1$–$C_4$-alkyl, $C_1$–$C_4$-alkoxy, fluorine, chlorine or bromine as substituents, $C_1$–$C_4$-alkanoyloxy, $C_1$–$C_6$-alkoxycarbonyloxy, $C_1$–$C_8$-alkoxycarbonyl, mono- or di-$C_1$–$C_8$-alkylaminocarbonyloxy, in the last three of which the carbon chain may be interrupted by one or two oxygen atoms in ether function;

$C_3$–$C_5$-alkenyl or $C_5$–$C_7$-cycloalkyl; phenyl which may be substituted by $C_1$–$C_4$-alkyl, $C_1$–$C_4$-alkoxy, $C_1$–$C_4$-dialkylamino, acetylamino, fluorine, chlorine or bromine;

$R^5$ is hydrogen; chlorine;

$C_1$–$C_4$-alkyl, $C_1$–$C_4$-alkoxy, $C_1$–$C_4$-alkanoylamino, which may have $C_1$–$C_4$-alkoxy, phenoxy or chlorine as substituents, $C_2$–$C_3$-alkenoylamino, benzoylamino, ureido, mono- or di-$C_1$–$C_4$-alkylureido or $C_1$–$C_4$-alkylsulfonylamino;

$R^6$ is hydrogen, chlorine, $C_1$–$C_4$-alkyl or $C_1$–$C_4$-alkoxy;

$R^7$ is hydrogen, $C_1$–$C_8$-alkyl or phenyl;

$R^8$ is hydrogen, $C_1$–$C_8$-alkyl, which may have phenyl, furyl or thienyl as substituents, $C_5$–$C_7$-cycloalkyl or phenyl.

3. A process for transferring an azo dye by diffusion from a transfer to a plastic-coated substrate with the aid of a heat source, which comprises using for this purpose of transfer on which there is or are situated one or more azo dyes of the formula I

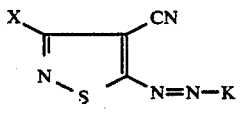

I in which the substituents have the following meanings:

X is a radical of the formula IIb

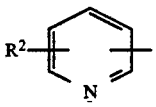

IIb where $R^2$ is hydrogen, $C_1$–$C_4$-alkyl, $C_1$–$C_4$-alkoxy, chlorine or bromine, and K is the radical of a coupling component III

H—K III of an aniline, aminoaphthaline, pyrazole, diaminopyridine, hydroxypyridone or tetrahydroquinoline.

4. A process as claimed in claim 3, wherein K is of:

aniline derivatives of formula IIIa

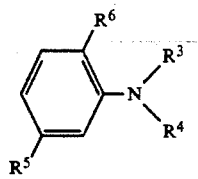

IIIa aminoaphthaline derivatives of the formula IIIb

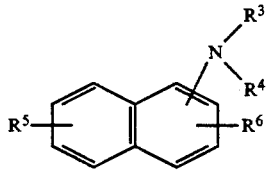

IIIb pyrazole derivatives of the formula IIIc

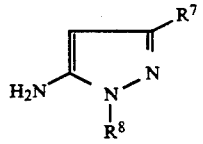

IIIc diaminopyridine derivatives of the formula IIId

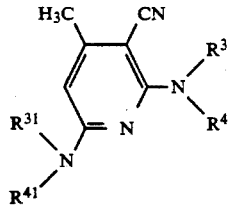

IIId hydroxypyridone derivatives of the formula IIIe

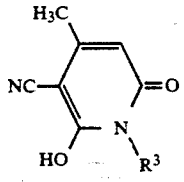

IIIe tetrahydroquinoline derivatives of the formula IIIf

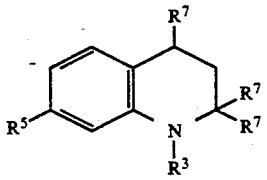

IIIf wherein $R^3$, $R^{3'}$, $R^4$ and $R^{4'}$ are each hydrogen;

$C_1$–$C_{10}$-alkyl whose carbon chain may be interrupted by from one to three oxygen atoms in ether function and which may bear the following substituents: cyano, hydroxyl, phenyl, phenoxy, phenylaminocarbonyloxy, benzyloxy, benzoyloxy, which may have $C_1$–$C_4$-alkyl, $C_1$–$C_4$-alkoxy, fluorine, chlorine or bromine as substituents, $C_1$–$C_4$-alkanoyloxy, $C_1$–$C_8$-alkoxycarbonyloxy, $C_1$–$C_8$-alkoxycarbonyl, mono- or di-$C_1$–$C_8$-alkylaminocarbonyloxy, in the last three of which the carbon chain may be interrupted by one or two oxygen atoms in ether function;

$C_3$–$C_5$-alkenyl or $C_5$–$C_7$-cycloalkyl; phenyl which may be substituted by $C_1$–$C_4$-alkyl, $C_1$–$C_4$-alkoxy, $C_1$–$C_4$-dialkylamino, acetylamino, fluorine, chlorine or bromine;

$R^5$ is hydrogen; chlorine;

$C_1$–$C_4$-alkyl, $C_1$–$C_4$-alkoxy, $C_1$–$C_4$-alkanoylamino, which may have $C_1$–$C_4$-alkoxy, phenoxy or chlorine as substituents, $C_2$–$C_3$-alkenoylamino, benzoylamino, ureido, mono- or di-$C_1$–$C_4$-alkylureido or $C_1$–$C_4$-alkylsulfonylamino;

$R^6$ is hydrogen, chlorine, $C_1$–$C_4$-alkyl or $C_1$–$C_4$-alkoxy;

$R^7$ is hydrogen, $C_1$–$C_8$-alkyl or phenyl;

$R^8$ is hydrogen, $C_1$–$C_8$-alkyl, which may have phenyl, furyl or thienyl as substituents, $C_5$–$C_7$-cycloalkyl or phenyl.

5. A process as claimed in claim 1, wherein the heat source is a thermal printing head.

6. A process as claimed in claim 3, wherein the heat source is a thermal printing head.

* * * * *